US012788127B2

(12) United States Patent
Kpakol et al.

(10) Patent No.: US 12,788,127 B2
(45) Date of Patent: Nov. 10, 2026

(54) FACEON SYSTEM AND METHOD

(71) Applicants: Blessing Kpakol, The Colony, TX (US); Delali Heidenfelder, The Colony, TX (US)

(72) Inventors: Blessing Kpakol, The Colony, TX (US); Delali Heidenfelder, The Colony, TX (US)

(73) Assignee: FaceOn LLC, The Colony, TX (US)

( * ) Notice: Subject to any disclaimer, the term of this patent is extended or adjusted under 35 U.S.C. 154(b) by 0 days.

(21) Appl. No.: 19/300,332

(22) Filed: Aug. 14, 2025

(65) Prior Publication Data

US 2026/0047663 A1 Feb. 19, 2026

Related U.S. Application Data

(60) Provisional application No. 63/683,141, filed on Aug. 14, 2024.

(51) Int. Cl.
*A45D 44/12* (2006.01)

(52) U.S. Cl.
CPC ..... *A45D 44/12* (2013.01)

(58) Field of Classification Search
CPC ..... A42B 1/014; A42B 1/018; A45D 44/12
USPC ..... 2/174, 46
See application file for complete search history.

(56) References Cited

U.S. PATENT DOCUMENTS

| | | | | | |
|---|---|---|---|---|---|
| 5,577,271 | A * | 11/1996 | Davis | A01K 55/00 | 2/202 |
| 6,233,738 | B1 * | 5/2001 | Siracusa | A01K 55/00 | 2/202 |
| 2006/0005300 | A1 * | 1/2006 | St-Germain | A42B 1/0182 | 2/209.13 |
| 2014/0201881 | A1 * | 7/2014 | Musto | A45D 44/08 | 2/46 |

* cited by examiner

*Primary Examiner* — Timothy K Trieu
(74) *Attorney, Agent, or Firm* — Kirby Drake

(57) ABSTRACT

A system and method may be provided for minimizing or avoiding the transfer of or smearing of cosmetics and/or beauty care on clothing. More specifically, the FaceOn system may include a top portion that may have a bubble-type shape to receive a person's head and a trim or border on the lower part of the top portion that sits on or around the person's shoulders when worn by a person. The FaceOn system may be formed of different materials including, but not limited to, silk and polyester, and should be formed of a material such that the person can see through the material when the FaceOn system is in use.

8 Claims, 3 Drawing Sheets

FACEON SYSTEM AND METHOD

CROSS-REFERENCE TO RELATED APPLICATION

The present Application is a non-provisional of, and claims priority to, U.S. Patent Application No. 63/683,141 filed Aug. 14, 2024, the disclosure of which is incorporated by reference in its entirety.

FIELD OF THE DISCLOSURE

The present disclosure generally relates to cosmetic and/or beauty care applications, and more particularly to cosmetic and/or beauty care applications that prevents product/makeup transferring to/smearing on clothing.

BACKGROUND

A common problem occurs when applying cosmetics or other beauty care products, namely, the smearing or transfer of cosmetics or other beauty care products to clothing. For example, a person applies makeup and then seeks to pull their top/blouse/other clothing over their face, leading to the smearing of makeup on the top/blouse/other clothing and/or transfer of the makeup from the person's face to the top/blouse/other clothing. Not only may the person's makeup be messed up or smeared on their clothing in the process, but this also may require a time-consuming and/or difficult process to try to remove the stains from the top.

SUMMARY

A system and method may be provided for minimizing or avoiding the transfer of or smearing of cosmetics and/or beauty care on clothing in embodiments of the present disclosure. In embodiments of the present disclosure, the FaceOn system may include a top portion that may have a bubble-type shape to receive a person's head and a trim or border on the lower part of the top portion that sits on or around the person's shoulders when worn by a person; however, the top portion may be formed of different shapes and sizes to accommodate differently sized and/or shaped heads. The FaceOn system may be formed of different materials including, but not limited to, silk and polyester, and should be formed of a material such that the person can see through the material when the FaceOn system is in use.

Embodiments of the present disclosure may provide a face and clothing protection system comprising: a top portion having a bubble-type shape to receive a person's head and formed of a material that allows a person to see through the material when the top portion is on the person's head; and a border on a lower part of the top portion that sits on or around the person's shoulders when worn by the person, wherein the face and clothing protection system is configured to allow the person to put on or remove clothing while wearing the system while protecting makeup or skincare applied to the person's face. The top portion may be formed of organza fabric. It may be formed of silk or polyester. The border may be satin encased. The border also may include a fastening mechanism to secure the face and clothing protection system in place when worn by the person. The fastening mechanism may be a hook-and-loop fastener or a drawstring. The border may include elastic to stretch to accommodate various hairstyles of the person while maintaining its structural integrity.

Other embodiments of the present disclosure may provide a method for using a face and clothing protection system comprising: holding a border of the face and clothing protection system with organza fabric forming a top portion attached to the border draped downward, the border having an elastic band with a satin edge; placing the elastic band under a person's chin with the satin edge resting against the person's skin; and pulling the elastic band over the person's head to secure around the person's head or neck, wherein a seal is formed to prevent makeup, skincare, and hair products from reaching the person's clothing and the organza fabric provides the person with visibility while dressing. The elastic band may expand up to 3-4 times its resting size when pulled over the person's head. The elastic band may be pulled to secure at the person's hairline when applying makeup to allow full access to the person's face.

BRIEF DESCRIPTION OF THE DRAWINGS

For a more complete understanding of this disclosure, reference is now made to the following description, taken in conjunction with the accompanying drawings, in which.

DETAILED DESCRIPTION

Embodiments of the present disclosure may provide a system and method for minimizing or avoiding the transfer of or smearing of cosmetics and/or beauty care on clothing. More specifically, the FaceOn system may include a top portion that may have a bubble-type shape to receive a person's head and a trim or border on the lower part of the top portion that sits on or around the person's shoulders when worn by a person. As described herein, the FaceOn system may be formed of different materials including, but not limited to, silk and polyester, and should be formed of a material such that the person can see through the material when the FaceOn system is in use.

Figure 1:
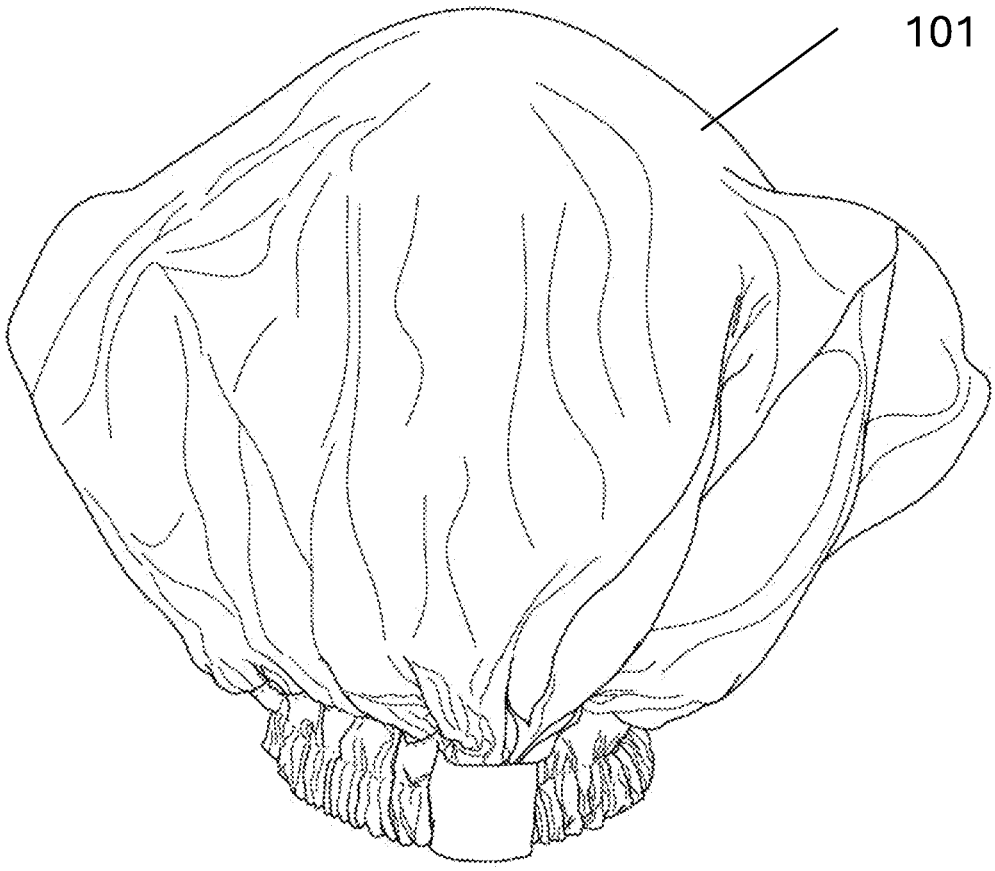
FIG. 1 depicts a FaceOn system according to an embodiment of the present disclosure.

FIG. 1 depicts a FaceOn system according to an embodiment of the present disclosure. More specifically, material which may include but is not limited to polyester, organza, and/or silk may be formed as a bubble-type shape top portion 101 to receive a person's head. It also should be appreciated that the material may be provided in a plurality of different colors. Regardless what material may be used for the bubble-type shape top portion 101, it should be appreciated that it should have a color and/or opacity such that the person may still be able to see through the material when it is placed on the person's head. Some materials such as organza may provide more structured draping around the person's head in embodiments of the present disclosure. This may allow the person to put on or remove clothing or perform other activities while still wearing the FaceOn system in embodiments of the present disclosure.

Figure 3:
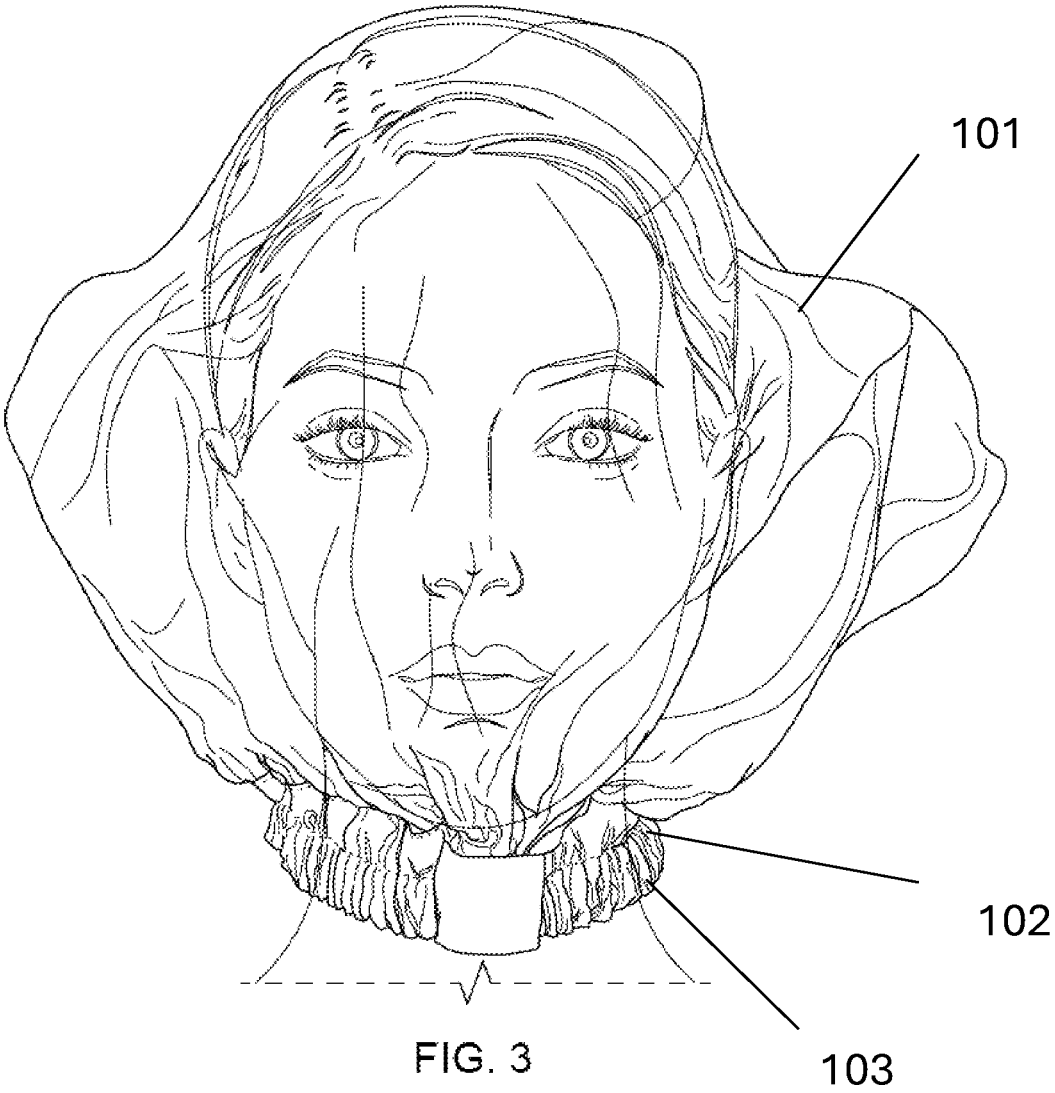
FIG. 3 depicts a person using the FaceOn system according to an embodiment of the present disclosure.

While this top portion 101 is described as having a bubble-type shape, it should be appreciated that other shapes may be employed without departing from the present disclosure. Regardless what shape is employed for the top portion 101 of the FaceOn system, it should be appreciated that it should be of a size and shape to receive the person's head when used as depicted, for example, in FIG. 3 There may be embodiments where the top portion 101 of the FaceOn system may be provided in a variety of shapes and sizes to accommodate heads of various shapes and sizes.

Figure 2:
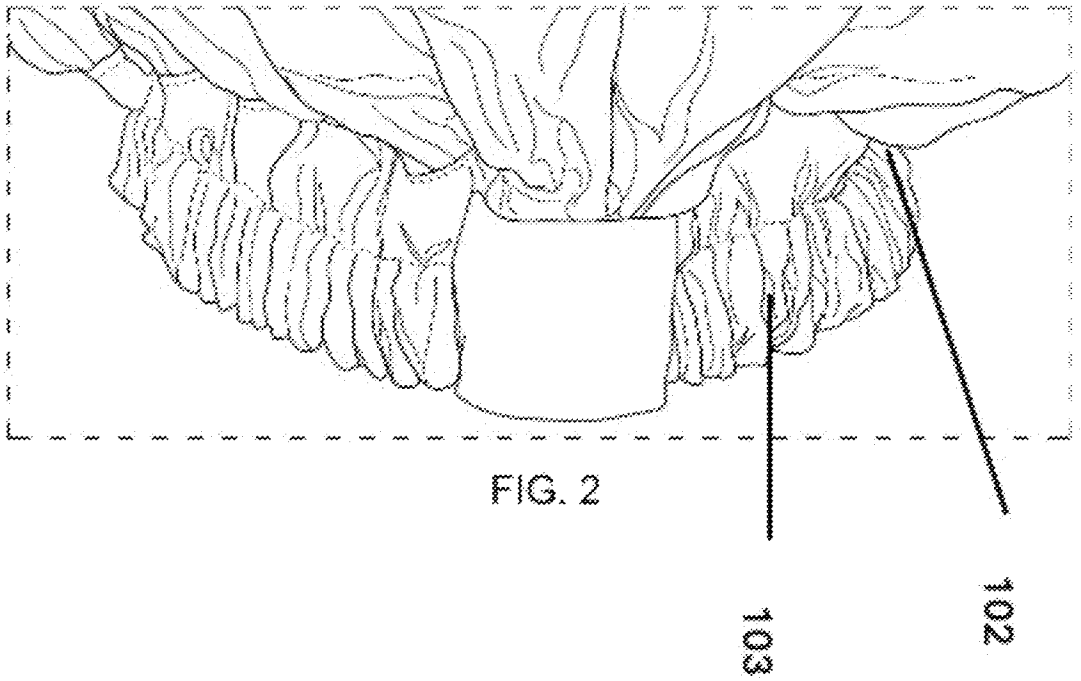
FIG. 2 depicts the base portion of the FaceOn system according to an embodiment of the present disclosure.

FIG. 2 depicts the base (or bottom or lower part of top) portion 103 of the FaceOn system according to an embodiment of the present disclosure. The fabric may include a trim or border 102 around the bottom (also referred to as the lower part of the top portion) 103 of the FaceOn system such that it may rest at or around the person's neck and shoulders when worn by the person. The trim or border 102 may be formed of the same material as the bubble-type shape portion in an embodiment of the present disclosure. However, should be appreciated that the trim or border 102 may be formed of a different material than the bubble-type shape portion without departing from the present disclosure. For example, there may be some embodiments where the trim or border 102 may be satin-encased providing more comfort for the user as well as durability in use; however, other materials may be used to encase the trim or border without departing from the present disclosure. In some embodiments of the present disclosure, the trim or border 102 may include a fastening mechanism such as a hook-and-loop fastener or a drawstring to ensure that the FaceOn system is securely in place when worn by the person as in FIG. 3.

To use the FaceOn system, one should use clean hands to hold it by the satin-encased elastic band with the organza fabric draped downward. The premium elastic is designed to stretch to accommodate various hairstyles while maintaining its structural integrity. The elastic band is placed under the person's chin with the satin edge resting comfortably against the person's skin. The materials forming the FaceOn system ensure a gentle touch against even the most sensitive skin. The elastic band may then be gently pulled over the person's head, allowing it to expand up to 3-4 times its resting size. The elastic will naturally secure around the person's head or neck, creating a perfect seal that prevents makeup, skincare, and hair products from reaching the person's clothing. Once secured, the transparent organza fabric allows for complete visibility while dressing. The lightweight material will not interfere with the person's vision or movements, letting the person continue their routine with confidence.

Accordingly, when a person wears the FaceOn system, it should stay in place so that the person may put on or remove clothing without transferring makeup from the face to the clothing. While embodiments are described herein with respect to avoiding transfer of makeup from a person's face to clothing, it should be appreciated that the FaceOn system may be used in other embodiments, for example, to avoid transfer of facial masks or creams from the person's face to clothing.

The FaceOn system according to embodiments of the present disclosure accommodates most hairstyles, including updos and elaborate styling. For particularly voluminous styles, the elastic may be stretched a bit more during application. If applying makeup while using the FaceOn system, the elastic may be positioned at the hairline to protect the person's hair while allowing full access to their face.

The FaceOn system may provide multiple benefits including, but not limited to, wardrobe investment protection. Garments can be protected/preserved from makeup, skincare, and hair product transfer during daily beauty and dressing rituals. The FaceOn system may provide premium comfort in design as it may be crafted with fine organza fabric and a soft satin elastic casing. This may deliver a luxurious feel while maintaining perfect structural integrity. Further, the organza fabric is sheer and professional grade which ensures unobstructed vision while providing complete protection during beauty and dressing changes.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A face and clothing protection system comprising:

a top portion having a bubble-type shape to receive a person's head and formed of a material that allows a person to see through the material when the top portion is on the person's head; and a satin-encased soft/lightweight elastic border on a lower part of the top portion integral with the top portion that sits on or around the person's shoulders when worn by the person, wherein the satin-encased elastic border expands up to 3-4 times its resting size when pulled over the person's head, wherein the face and clothing protection system is configured to allow the person to put on or remove clothing while wearing the system while protecting makeup or skincare applied to the person's face.

2. The face and clothing protection system of claim 1, wherein the top portion is formed of organza fabric.

3. The face and clothing protection system of claim 1, wherein the top portion is formed of silk or polyester.

4. The face and clothing protection system of claim 1, the border further comprising:

a fastening mechanism to secure the face and clothing protection system in place when worn by the person.

5. The face and clothing protection system of claim 4, wherein the fastening mechanism is a hook-and-loop fastener or a drawstring.

6. The face and clothing protection system of claim 1, wherein the border includes elastic to stretch to accommodate various hairstyles of the person while maintaining its structural integrity.

7. A method for using a face and clothing protection system comprising:

holding a border of the face and clothing protection system with organza fabric forming a top portion integral with the border draped downward, the border having an elastic band that is soft/lightweight and encased with satin;

placing the elastic band under a person's chin with the satin encasement resting against the person's skin; and pulling the elastic band over the person's head to secure around the person's head or neck, wherein the elastic band expands up to 3-4 times its resting size when pulled over the person's head and wherein a seal is formed to prevent makeup, skincare, and hair products from reaching the person's clothing and the organza fabric provides the person with visibility while dressing.

8. The method of claim 7, wherein the elastic band is pulled to secure at the person's hairline when applying makeup to allow full access to the person's face.

* * * * *